US005170100A

United States Patent [19]

Shichao et al.

[11] Patent Number: 5,170,100

[45] Date of Patent: Dec. 8, 1992

[54] ELECTRONIC FLUORESCENT DISPLAY SYSTEM

[75] Inventors: Ge Shichao, Hangzhou, China; Victor Lam, Saratoga, Calif.; Huang Xi, Hangzhou, China; Jin Weicheng, Hangzhou, China; Ruan Shiping, Hangzhou, China

[73] Assignees: Hangzhou University, Hangzhou, China; Panocorp Display Systems, Santa Clara, Calif.

[21] Appl. No.: 657,867

[22] Filed: Feb. 25, 1991

[30] Foreign Application Priority Data

Mar. 6, 1990 [CN] China ..... 90101232

[51] Int. Cl.[5] ..... G09G 1/04; H01J 29/70

[52] U.S. Cl. ..... 315/366; 313/422

[58] Field of Search ..... 315/366; 313/422

[56] References Cited

U.S. PATENT DOCUMENTS

| | | | |
|---|---|---|---|
| 2,500,929 | 3/1950 | Chilowsky | 313/422 |
| 3,935,499 | 1/1976 | Oess . | |
| 3,935,500 | 1/1976 | Oess et al. . | |
| 4,377,769 | 3/1983 | Beatty et al. . | |
| 4,707,638 | 11/1987 | Hara et al. . | |
| 4,719,388 | 1/1988 | Oess . | |
| 4,737,683 | 4/1988 | Shichao et al. . | |
| 4,812,716 | 3/1989 | Miyama et al. | 315/366 |
| 4,881,017 | 11/1989 | Tsuruoka | 313/422 |
| 4,973,888 | 11/1990 | Morimoto et al. | 315/366 |
| 5,083,058 | 1/1992 | Nonomura et al. | 313/482 |

FOREIGN PATENT DOCUMENTS 261896 3/1988 European Pat. Off. .

*Primary Examiner*—Gregory C. Issing

*Attorney, Agent, or Firm*—Majestic, Parsons, Siebert & Hsue

[57] ABSTRACT

A cathodoluminescent device employs elongated grid electrodes such as small gauge wires for addressing and controlling the brightness of the display, thereby increasing the osmotic coefficient of the grid electrodes. End portions of the cathode filaments are bent into springs to reduced cold terminal effects. The edges of the face plate of the device are curved to reduced the visual effects of mosaic slots. The display may be operated at low anode voltage with increased luminescence so that full screen scanning is possible. Different sections of narrow strips forming a staggered structure strengthens the integrity of the device and reduces dark areas in the display.

22 Claims, 6 Drawing Sheets

FIG. 1a.
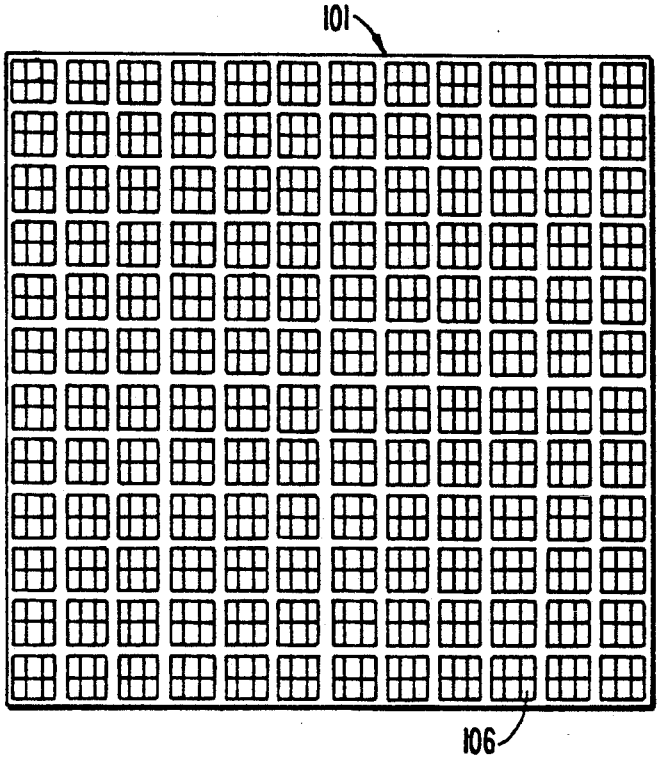
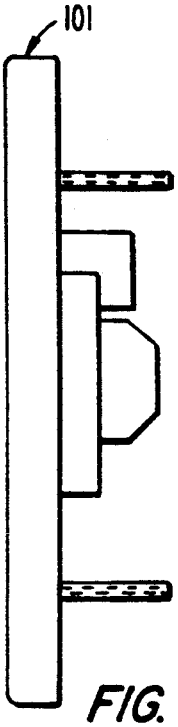
FIG. 1c.
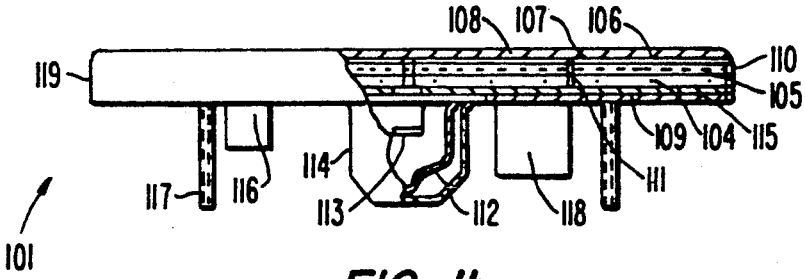
FIG. 1b.

ELECTRONIC FLUORESCENT DISPLAY SYSTEM

BACKGROUND OF THE INVENTION

This invention relates in general to electronic fluorescent display devices and in particular, to a low voltage cathodoluminescent device particularly useful for flat mosaic large-screen and ultra-large screen full color hang-on-wall type displays.

Cathode ray tubes (CRT) have been used for display purposes in general, such as in conventional television systems. The conventional CRT systems are bulky primarily because depth is necessary for an electron gun and an electron deflection system. In many applications, it is preferable to use flat display systems in which the bulk of the display is reduced. In U.S. Pat. No. 3,935,500 to Oess et al., for example, a flat CRT system is proposed where a deflection control structure is employed between a number of cathodes and anodes. The structure has a number of holes through which electron beams may pass with a set of X-Y deflection electrodes associated with each hole. The deflection control structure defined by Oess et al. is commonly known as a mesh-type structure. While the mesh-type structure is easy to manufacture, such structures are expensive to make, particularly in the case of large structures.

Mosaic large-screen full color displays have been used frequently in public environments such as sports stadiums and exhibition halls. Several types of mosaic full color large-screen displays have been in use or proposed. In one type known as the flat matrix CRT, its anode voltage is as high as 8 kilovolts or higher and has low phosphor dot density. It is mainly used in the outdoor environment. Because of the above-described characteristics, it is difficult to construct a thin, high dot density display for use in indoor applications such as for hang-on-wall televisions using the flat matrix CRT.

Another conventional system currently used is known as the Jumbotron such as that described in Japanese Patent Publication Nos. 62-150638, 62-52846. The structure of Jumbotron is somewhat similar to the flat matrix CRT described above. Again the anode voltage is as high as 8 kilovolts or above and the display panel at least over 1 inch in thickness. Each anode includes only less than 20 pixels so that it is difficult to construct a high phosphor dot density type display system using the Jumbotron structure.

Both the flat matrix CRT and Jumbotron structures are somewhat similar in principle to the flat CRT system described by Oess et al. discussed above. These structures amount to no more than enclosing a number of individually controlled electron guns within a panel, each gun equipped with its own grid electrodes for controlling the X-Y addressing and/or brightness of the display. In all the above-described devices, the control grid electrodes used are in the form of mesh structures. These mesh structures are typically constructed using photo-etching by etching holes in a conductive plate. The electron beams originating from the cathodes of the electron guns then pass through these holes in the mesh structure to reach a phosphor material at the anodes. As noted above, mesh structures are expensive to manufacture and it is difficult to construct large mesh structures. For this reason, each cathode has its own dedicated mesh structure for controlling the electron beam originating from the cathode. Since the electron beam must go through the hole in the mesh structure, a large number of electrons originating from the cathode will travel not through the hole, but lost to the solid part of the structure to become grid current so that only a small portion of the electrons will be able to escape through the hole and reach the phosphor material at the anode. For this reason the osmotic coefficient, defined as the ratio of the area of the hole to the area of the mesh structure of the cathode, of the above-described devices is quite low.

To counteract the low osmotic coefficient and also to increase phosphor brightness in these devices, high voltages are used such as 8 kilovolts or above. To prevent undesirable arcing, it is therefore necessary to increase the distance between the anode and cathode, thereby resulting in a thick display device. Furthermore, since each cathode has its own dedicated mesh structure, in order to avoid mutual interference between adjacent mesh structures, it is necessary to leave sufficient spacing between the mesh structures of adjacent cathodes. For this reason, each display panel in the above-described devices includes less than 20 pixels so that it is difficult to construct a high phosphor dot density type display system using the above-proposed structures.

Another conventional mosaic full color large-screen display system is the color vacuum fluorescent display such as that described in Japanese Patent Publication No. 62-52836. It employs a cathode, an anode, and one grid. An auxiliary cathode and light leader are used to increase dot density. The anode voltage used is around 300 volts. The anode and grid are used for X-Y addressing. Since the anode is used in addressing, the anode voltage cannot be higher than 300 volts in order to prevent electrical shorts between anodes. However, the luminescence of the three primary colors red, blue and green (R, B and G) phosphors are low at voltages such as 300 volts and below. Furthermore, at such voltages, the phosphors have short lifetimes.

In the above-described three types of mosaic full screen displays, complex electronic circuitry is required which takes up considerable space behind the display. The face plate of the systems used in these devices are thick so that it is difficult to construct high density and thin devices which can be used as hang-on-wall televisions.

Yet another conventional mosaic full color large-screen structure that has been used is back lighting liquid crystal displays (LCD). Its structure has many thin film transistors R, B, G photoarrays so that it is difficult and expensive to manufacture. A large number of lighting sources need to be used behind the display screen and only a small portion of the light from the light sources is transmitted so that it is inefficient.

In all conventional mosaic displays constructed using a two-dimensional array of panels, there will be mosaic slots between the panels. These slots would appear as dark square or rectangular grid lines superimposed onto the displayed image and affects the quality of the displayed image. For back lighting LCD displays, the mosaic slots are relatively large which degrades the display image. Due to the large number of lighting sources behind the screen, these LCD devices are generally over 2 feet in thickness. It is therefore difficult to use the back lighting LCD in large-screen hang-on-wall television systems. Thus even though the back lighting LCD has high resolution, it has not been widely used.

SUMMARY OF THE INVENTION

This invention is based on the observation that by using two or more sets of elongated grid electrodes with electrodes in each set overlap those in the other set at pixel dots, the above-described difficulties with conventional systems are alleviated or avoided altogether. When the appropriate electrical potentials are applied to the anode, cathode, and a set of grid electrodes, the electrons emitted by the cathode are caused to travel to the anode at the pixel dots for displaying images. Since overlapping elongated grid electrodes are used in place of the conventional mesh structure, the osmotic coefficient is greatly increased. Since the grid electrodes serve to address and/or supply brightness data to a number of pixel dots, the pixel dots can be much closer together than the conventional displays where adequate spacing must be maintained between the adjacent mesh structures of adjacent electron guns.

Therefore, one aspect of the invention is directed towards a cathodoluminescent visual display device having a plurality of pixel dots. The device comprises an anode, luminescent means that emits light in response to electrons, and that is on or adjacent to the anode and the cathode. The device further comprises two or more sets of elongated grid electrodes between the anode and cathode and means for heating the cathode, causing the cathode to emit electrons. The electrodes in each set overlap those in at least one other set at points, wherein the overlapping points define the pixel dots. The device further includes means for applying electrical potentials to the anode, cathode and the two or more sets of grid electrodes, causing the electrons emitted by the cathode to travel to the anode at the pixel dots for displaying images.

In the preferred embodiment, a first, second and third set of grid electrodes are used which are respectively in the first, second and third planes between the planes of the cathode and anode. Each of at least some grid electrodes in the first set is parallel to and corresponds to a grid electrode in the third set defining a pair of corresponding electrodes. The same electrical potential is applied to the pair of corresponding electrodes to enable more electrons to travel beyond to the second set of grid electrodes and to reach the anodes, thereby increasing the luminescence of the device.

Also in the preferred embodiment, the cathode includes one or more filaments, each comprising a center core material and a coating, and two springs connecting each filament to the housing. The springs are made of substantially the same material as the filament center core material, thereby reducing cold terminal effects.

Another aspect of the invention reduces the visual effects of mosaic slots. In accordance with this aspect, a display device includes a housing which has a face plate having an edge and an inside surface inside the housing, and a side plate connected to the face plate at or near the edge to form a portion of the housing. The face plate is made of a transparent material. The device further includes luminescent means on or in the vicinity of set inside surface and in the vicinity of set edge. The luminescent means emits light through the face plate for displaying visual images. The face plate has an outside surface at or near the edge through which light from the luminescent means passes. The outside surface of the face plate is curved and of such a shape that the virtue image of the luminescent means to an observer outside of the housing appears to be at a predetermined fixed location in the side plate to reduce the effects of mosaic slots in mosaic displays constructed using the device. The device is useful in PDP, flat CRT, EL, LCD, EPD, or ECD type.

In conventional mosaic type displays, the air inside the housing of the display is evacuated. The housing therefore would have to withstand atmospheric pressure. The use of spacers between the face and back plates have been proposed in conventional mosaic displays. However, such spacers usually are members extending between the face and back plates so that the presence of the members create dark areas in the display, which is undesirable. Another aspect of the invention is directed towards the observation that such dark areas may be reduced by using a number of spacer means between the face and the back plate. According to another aspect of the invention, a visual display device comprises an anode, a cathode, a plurality of sets of elongated grid electrodes between the anode and cathode, and housing means holding the anode, cathode and grid electrodes. The anode and cathode are in respectively the anode plane and the cathode plane that are spaced apart. The sets of grid electrodes are each in its respective plane that is different from one another, set planes of the grid electrodes being located between the anode and cathode planes where the first set of grid electrodes closer to the cathode than the anode and the second set of grid electrodes between the first set of electrodes and the anode. The device further comprises a first spacer means between the back plate and the first set of grid electrodes, one or more second spacer means between the first and second sets of grid electrodes and a third spacer means between the anode and the second set of grid electrodes. In the preferred embodiments, the first, second and third spacer means are elongated members where the length of the member of at least one of the second spacer means transfers to the lengths of the members of the first and third spacer means.

Due to the increased osmotic coefficients and luminescence as a result of the above-described aspects of the invention, it is possible to use much simpler circuitry for control than in conventional mosaic display systems. According to yet another aspect of the invention, a mosaic visual display device comprises N rows and M columns of display panels, N, M being positive integers. Each panel includes an anode, luminescent means that emits light in response to electrons and that is on or adjacent to the anode and the cathode. Each panel further includes two or more sets of elongated grid electrodes between the anode and cathode, said sets including one set of n scanning electrodes and a set of m data electrodes, n, m being positive integers. The n scanning electrodes and m data electrodes overlap one another at points and define a matrix of n.m pixel dots at the overlapping points, said matrix having n rows. The device further comprises n first drivers, each connected to one of the n scanning electrodes for scanning the n rows of the matrix and N second drivers, each connected to the cathodes of one of the N rows of panels, said first and second drivers in combination scanning all the n.N rows of pixel dots in the device.

BRIEF DESCRIPTION OF THE DRAWINGS

FIG. 1*a* is a top view of a flat matrix electronic fluorescent device to illustrate the preferred embodiment of the invention.

FIG. 1*b* is a partially side view and partially cross-sectional view of the device in FIG. 1*a*.

FIG. 1c is a side view of the device in FIG. 1a for a direction perpendicular to the view taken in FIG. 1b.

FIG. 5b is a graphical illustration of the feature of the invention in FIG. 5a.

FIG. 6b is a timing diagram to illustrate the operation of the circuit of FIG. 6a.

DETAILED DESCRIPTION OF THE INVENTION

Figure 2:
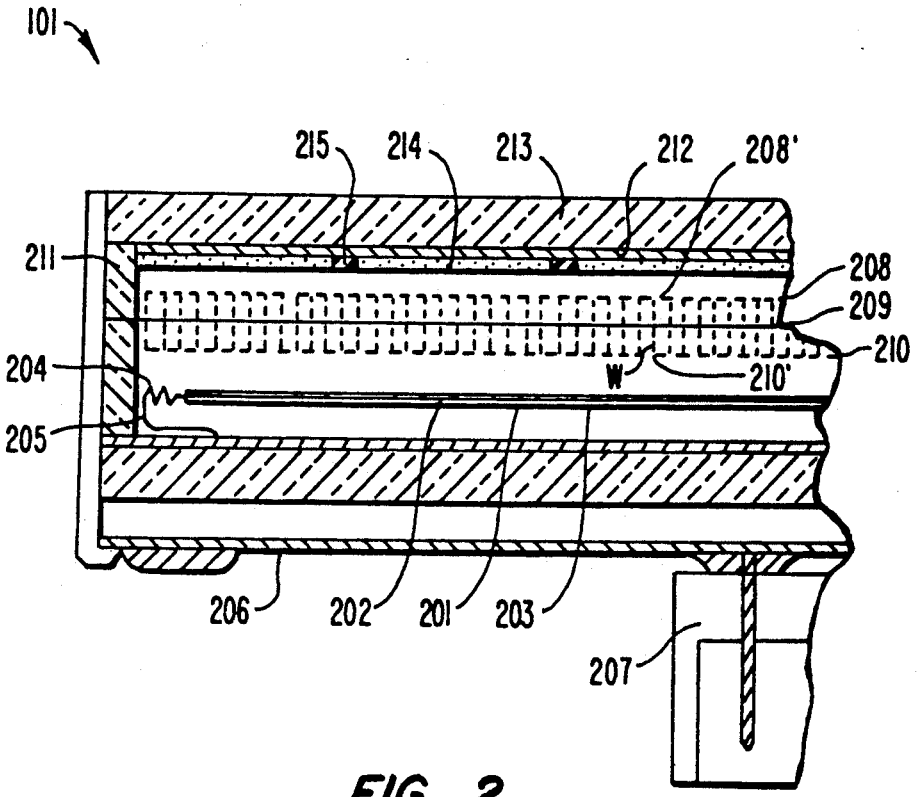
FIG. 2 is a cross-sectional view of a portion of the device in FIG. 1a showing in more detail the internal structure of the device.

FIG. 1a is a top view of a flat electronic fluorescent display device 101 to illustrate the preferred embodiment of the invention. As shown in FIG. 1a, device 101 has twelve rows and twelve columns of pixels. Where a large number of devices such as 101 are placed side by side next to each other in a two-dimensional array, these devices form a mosaic full color full screen display. FIGS. 1b, 1c are side views from two different directions of device 101 of FIG. 1a where in FIG. 1b, a portion of the device is shown in cross-section.

Referring to FIGS. 1a, 1b, 1c, device 101 includes a direct heating type oxide-coated filament cathode 104, two or three grids 105, anode 107 on which is deposited three primary color phosphor dots 106. While in the preferred embodiment, dots 106 are shown as being present on anode 107, it will be understood that, for the purposes of the invention, the dots may also be adjacent to the anode; such modifications and other arrangements are within the scope of the invention.

The cathode grids and anode are housed within a housing comprising a face plate 108 and a back plate 109 connected together by means of a side wall 110 to form a flat panel housing with a chamber therein which is evacuated. Cathode 104, grids 105 and anode 107 are sealed to the housing of this chamber by means of glass frit. The side walls of the vacuum chamber and spacers 111 are used to support and fix the positions of the grid electrodes and to increase the strength of the housing in resisting atmospheric pressure. Exhaust pipe 112 has a getter 113 therein and is protected by a cover 114. The leads (not shown) for connecting the anode, cathodes and grid electrodes to the outside drive circuits are wires or conductive traces on printed circuit board 115. In the preferred embodiment, board 115 is glued to the display panel to form a unitary body. Board 115 has connectors 116 for connecting the board electrically to outside devices and screws 117 for mounting device 101 onto a support structure. A DC/AC converter 118 is connected to board 115 for applying a AC voltage for the purpose of heating the cathode filament. A black sealing elastic protective ring 119 is mounted onto the side wall of the device.

When a rated voltage is applied to cathode filament by means of converter 118, and when the filament is heated to a high temperature, the cathode filament will emit electrons. These electrons are accelerated by means of the potential difference between cathode 104 and grids 105 and will travel to the phosphor dots on the anode which is at a much higher voltage than the cathode. The phosphor will be excited by the electrons to emit red, green or blue light for full color display image.

FIG. 2 is a cross-sectional view of a portion of device 111 of FIG. 1a to illustrate in more detail the structure of the device. Direct heating oxide-coated filament cathode includes a metallic core 202 with a coating 203 of electron emitting material. In response to the rated voltage, filament 201 emits electrons. As shown in FIG. 2, device 101 includes three sets of grid electrodes 208 (G3), 209 (G2) and 210 (G1). In contrast to the mesh structure in conventional mosaic display devices, these three sets of grid electrodes are each made of elongated members such as small gauge alloy wires. The diameter of these wires are relatively small compared to the spacing between the wires so that the osmotic coefficient of these grid electrodes is much higher than that of the mesh structures in conventional mosaic devices; this greatly increases the proportion of electrons emitted by the cathode that will reach the phosphor material on the anode and therefore greatly increases the luminescence of the device.

In the preferred embodiment, these three sets of electrodes are each located in one of three planes defining a first, second and third plane in which the three sets of electrodes G1, G2, G3 are respectively located. Also in the preferred embodiment, each set of grid electrodes comprises a number of wires arranged parallel to one another where the middle set of electrodes 209 are substantially perpendicular to the electrodes in the remaining two sets 208, 210. As shown in FIG. 2, the electrodes in set 209 are substantially parallel to cathode 201 whereas those in sets 208, 210 are substantially perpendicular to the cathode and to the plane of FIG. 2. One of the three sets of grid electrodes is used for scanning and another set of carrying brightness information (data) for the phosphor. Points at which these two sets of electrodes overlap define the pixel dots of device 101. Obviously, a pixel may include one or more pixel dots.

In the preferred embodiment, the DC level of the cathode is in the range of 0–60 volts, the anode at 2,000 volts, set 209 of electrodes at voltages in the range of 0–60 volts and sets 208, 210 at voltages between 0–12 volts. Preferably, the anode is operated at a voltage substantially within the range of 500–3,000 volts. Obviously, other voltage ranges may also be used and this invention is not limited to the above-described ranges of voltages. The AC current used to heat the cathode may be supplied at a low voltage such as between 6–8 volts. In order for the anode to operate in the range of 500–3,000 volts, it is desirable to reduce the resistance of the phosphor material. This may be performed by any one of the conventional methods such as by soaking the phosphor in an electrically conductive solution or by mixing the phosphor with an electrically conductive powder such as metallic oxide before the treated phosphor is deposited onto the anode.

While three sets of grid electrodes are shown in FIG. 2, it will be understood that set 208 may be eliminated from device 101 although the use of set 208 will further increase the luminescence of device 101 for reasons explained below. Since it is possible for electrodes in set 209 to be under lower voltage compared to electrodes in set 210, when this happens and when the electrons travel past set 210 to reach the space between sets 209 and 210, some electrons may become attracted back towards the electrodes in set 210 and becomes grid current, thereby never reaching the phosphor material on the anode. This is caused by the local reverse electrical fields in the space between the electrodes in sets 209 and 210. As shown in FIG. 2, each electrode such as 208' overlaps electrodes in set 209 at the same pixel dot as a corresponding grid electrode 210' in set 210, forming a pair of corresponding electrodes. As shown in FIG. 2, each pair of corresponding electrodes in sets 208, 210 is connected electrically by a wire W so that the pair of corresponding electrodes are at the same electrical potential. Hence when an electrode in set 209 is at a low voltage such as 0 volts whereas the corresponding pair 208', 210' are at a relatively higher voltage (12 volts), the presence of a higher voltage on electrode 208' would dilute the effect of the localized reverse electric field which otherwise would be present between such electrode in set 209 and electrode 210'. Such dilution would reduce the tendency of the electrons to double back in the space between set 209 and electrode 210' and encourages such electron to penetrate the plane of set 209 and continue its travel towards the phosphor on the anode. While only three sets of grid electrodes are shown, it will be obvious that more than three sets of grid electrodes may be used and are within the scope of the invention. While the use of a device without set 208 is not as desirable, using only two sets of small gauge wire grid electrodes still achieves better performance compared to conventional mosaic devices discussed above.

The cathode may comprise a number of substantially parallel filaments where each filament emits electrons for one column of pixels such as shown in FIG. 1*a*. Each filament is connected at two ends to the printed circuit board by means of springs 204 and leads 205. The core 202 of the cathode is usually made of a very fine gauge wire and springs that are available commercially are typically much thicker and difficult to connect to the core 202. Furthermore, conventional springs typically have low resistance and will therefore be heated to a low temperature compared to core 202. The temperature differential between such spring and the end portion of core 202 will cause such end portion of the core to be at the lower temperature, thereby reducing the effectiveness of this portion of the filament in emitting electrons. According to the invention, spring 204 is formed from a continuation of core 202 by simply bending the two ends of core 202 into springs. These springs would permit the cathode to expand or contract without sagging and the tension maintained by these springs in the filament would reduce the amplitude of vibrations. By bending the end portions of core 202 into springs, it is unnecessary to connect the core to a separate spring and also reduces dark areas of the display caused by cold terminal effects discussed above. Springs 205 also serve as the support frame and leads followed onto board 206 and connected through connectors 207 to the system circuit.

Grid electrodes in sets 208, 209 and 210 are supported by side walls 211 and spacers to ensure that they have sufficient tension so as to reduce the amplitude of vibrations and the chances of short circuit which may cause damage to the device. As noted above, such structure of grid electrodes has high osmotic coefficient, causing the display panel to accomplish pulse luminescence above 500,000 cd/m$^2$ when the anode is operated at about 2,000 volts. As discussed further below, this permits full screen scanning and achieves sufficient average luminescence as a full color large screen television.

Anode 212 is formed by a continuous transparent layer on the inner surface of face plate 213. On top of the anode is the RGB three primary color phosphor dot array 214. Black insulating strips 215 between the phosphor dots enhance contrast of the display.

Figure 3A:
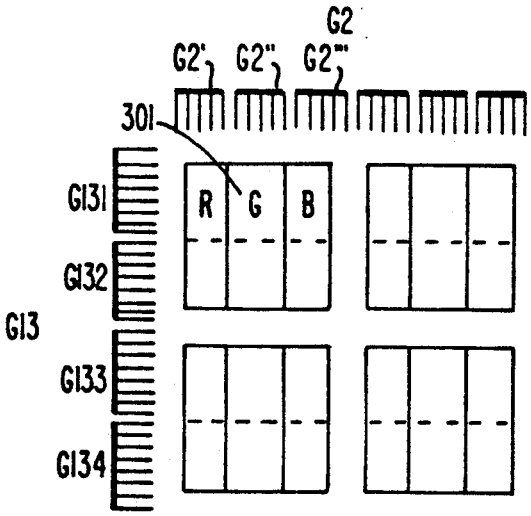
FIGS. 3a, 3b are schematic views of two embodiments of pixel dots and the corresponding addressing and data grid electrodes to illustrate the invention.
Figure 3B:
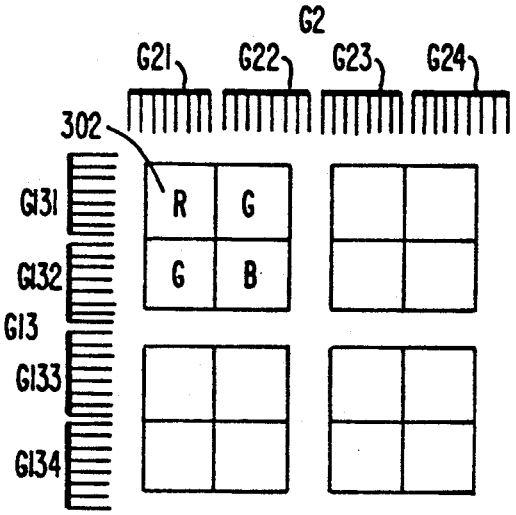

FIGS. 3*a*, 3*b* are schematic views of pixels and the associated grid electrodes to illustrate the preferred embodiment of the invention. FIG. 3*a* illustrates one configuration of pixels. As shown in FIG. 3*a*, each pixel 301 includes two areas, the top area includes red, green and blue portions and the bottom area includes similar portions. The top area is addressed or scanned by four pairs of corresponding electrodes in sets 208, 210 in FIG. 2. The brightness of the red portion is controlled by the common voltage on the electrodes G2' connected together. Similarly, the brightness of the green portion is controlled by the voltage on the electrodes G2'' and that of the blue portion by G2'''. If these three portions are to have uniform brightness, the four pairs of corresponding electrodes in sets 208 and 210 are connected together as one common set G131 as shown in FIG. 3. Obviously, it is possible for the four pairs of electrodes within G131 not to be connected and for the five electrodes in each of G2', G2'', G2''' not be connected to increase the resolution of the display.

FIG. 3*b* illustrates an alternative configuration for the makeup of the pixels. Again four pairs of corresponding electrodes in sets 208, 210 of FIG. 2 are connected together to form a common set G131. The G2 electrodes are grouped together in groups of wires, each group connected together in a similar manner for displaying phosphor dot 302.

Figure 4:
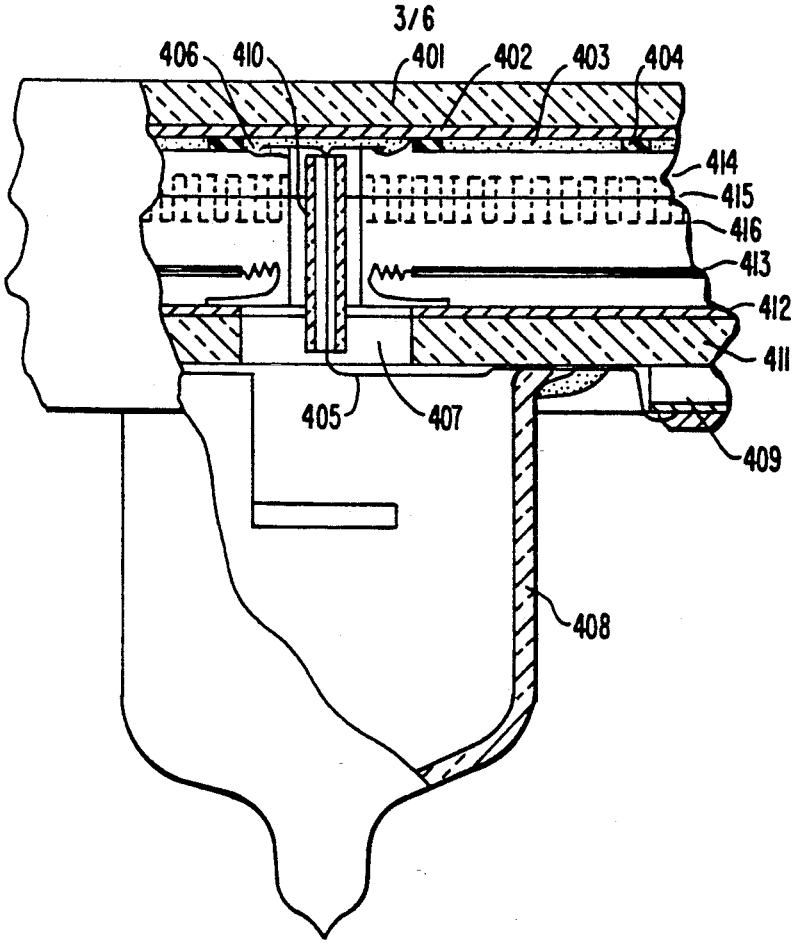
FIG. 4 is a cross-sectional view of a portion of the device in FIG. 1a showing in more detail the internal construction of the device.

FIG. 4 is a cross-sectional view of a section of the device 101 of FIG. 1. The transparent conductive film 402 forming the anode on face plate 401 may be made of $SnO_2$ or ITO; its resistance is preferably minimized and its transparency maximized. The primary color phosphor dots 403 and black insulating strips 404 are deposited onto the anode. Anode lead 405 separates into two branches at right angles before it is connected to anode 402 to increase the area of contact. These two branches are kept in place by a glass inner wall. A silver material 406 at the contact between lead 405 and film 402 further reduces resistance. Lead 405 passes through exhaust hole 407 and the bottom portion of exhaust pipe 408 and is connected to printed circuit board 409. Glass tube 410 surrounds lead 405 and prevents the high voltage applied to the anode to affect the grids and the uniformity of the display. The back glass plate 411 has on its inner surface a conductive film 412 connected to cathode 413 in order to prevent stability in light emission caused by electrostatic effects. Electrodes 414, 415 and 416 form the three sets of grid electrodes.

Figure 5A:
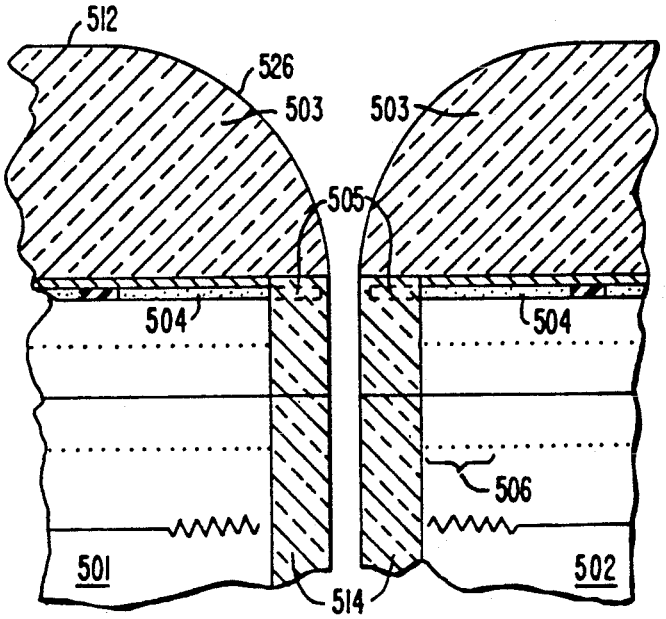
FIG. 5a is a cross-sectional view of a portion of a top corner portion of the device in FIG. 1a and of a similar portion of a second device of the same structure as that in FIG. 1a when the two devices are placed together side by side in a mosaic arrangement to illustrate the effectiveness of the invention in reducing the visual effects of mosaic slots.

One common problem in mosaic type displays is the visual effect of the spacing between the panels forming the mosaic display. Such spacing is commonly known as the mosaic slot. The visual effect of mosaic slots normally appears as a square or rectangular grid superimposed onto the visual picture. As shown in FIG. 5*a*, the edge portion 503 of the face plate is curved so that to an observer 510, light originating from portion 504 of the phosphor material would appear to originate from the virtual image 505. In other words, if the top surface 512 of the face plate were at right angles to the external surface of side plate 514, an observer at 510 would see a dark line whose width is equal to the widths of side plates 514 together with the spacing between the side plates. By making the edge portion 503 of the face plate curved as shown in FIG. 5*a*, the width of the dark line is reduced to substantially only the spacing between the side plates 514 between adjacent panels of the mosaic display.

It is preferable for the virtual image 505 to remain stationary in position even though the observer at position 510 may move in a direction parallel to surface 512 of the face plate. For this reason it is desirable to design the curvature of portion 503 to accomplish such purpose. This feature is illustrated in FIG. 5*b*.

Figure 5B:
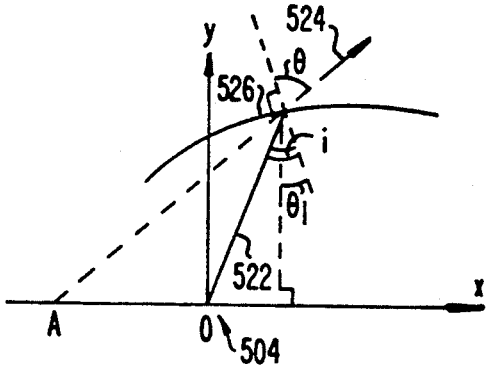

As shown in FIG. 5*b*, light originating from the origin O (corresponding to the near edge point of the phosphor 504 in FIG. 5*a*) will travel along path 522 before it hits surface 526 of edge portion 503 in FIG. 5*a*. At surface 526, the light beam 522 is refracted and emerges in direction 524 as shown in FIG. 5*b*. Thus to an observer whose eye sees beam 524, the image of the origin would appear to be a point A. In order for the virtual image A to remain stationary despite movement by the observer, it is desirable for the distance OA to remain constant despite changes in direction of beams 522, 524. The equations for obtaining the various angles of curvature of surface 526 to accomplish the desired goal are set forth as follows:

$$y.tg(\theta_1-\theta_2)-x=1=const$$

$$\sin\theta/\sin i=1.52=nu$$

$$tg(i-\theta_1)=x/y$$

$$y'=tg\theta_1$$

$$\Delta y=\Delta x.y'$$

In the above equations, nu is the index of refraction of the material in the face plate.

Using the above design, the phosphor dot density can be further increased to over 60,000 dots/m$^2$. Also as shown in FIG. 5*a*, in order to further compensate for the cold terminal effects discussed above caused by the use of springs at the end of cathode filaments, the spacing between the scanning electrodes in areas overlapping the filament, such as areas 506 in FIG. 5*a*, may be made smaller than the spacing in areas where the scanning electrodes do not overlap any springs. The denser spacing of the scanning electrodes will cause more electrons to be attracted to the area of the phosphor elements overlapping the springs; this will further increase the brightness of the display areas corresponding to the springs to achieve a more uniform brightness of the display.

Additionally, the scanning voltages applied to the scanning electrodes overlapping the spring may be made higher than the voltages applied to scanning electrodes not overlapping the spring, again resulting in the pulling of electrons to the phosphor elements overlapping the spring to achieve uniform brightness.

Figure 7:
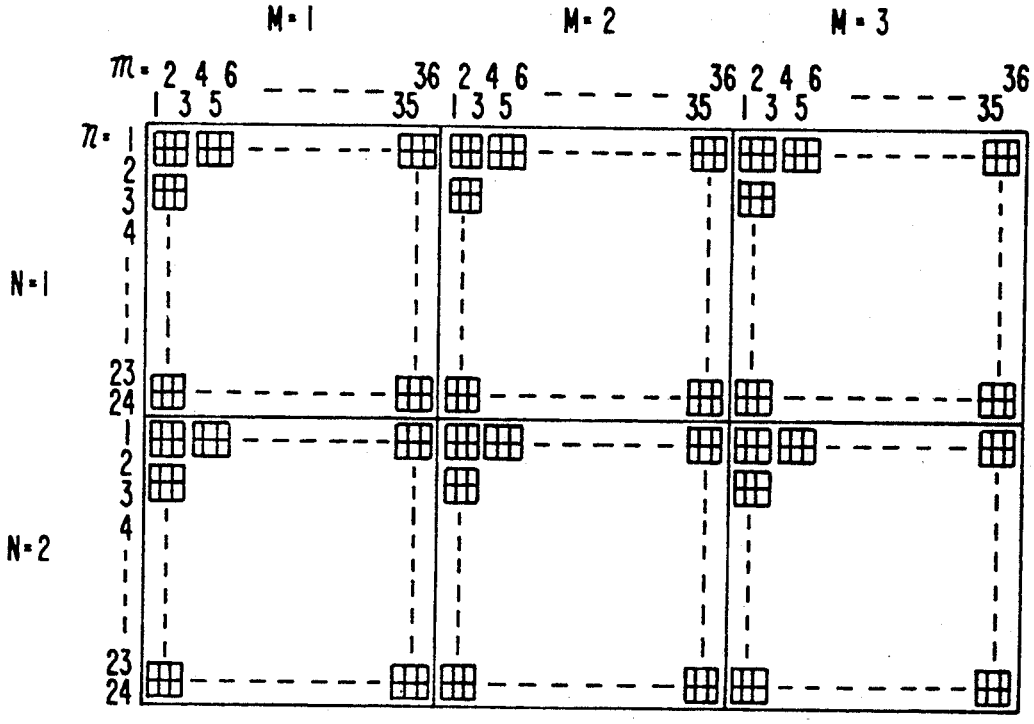
FIG. 7 is a schematic diagram of a mosaic visual display device comprising two rows and three columns of display panels to illustrate the preferred embodiment of the invention.
Figure 6A:
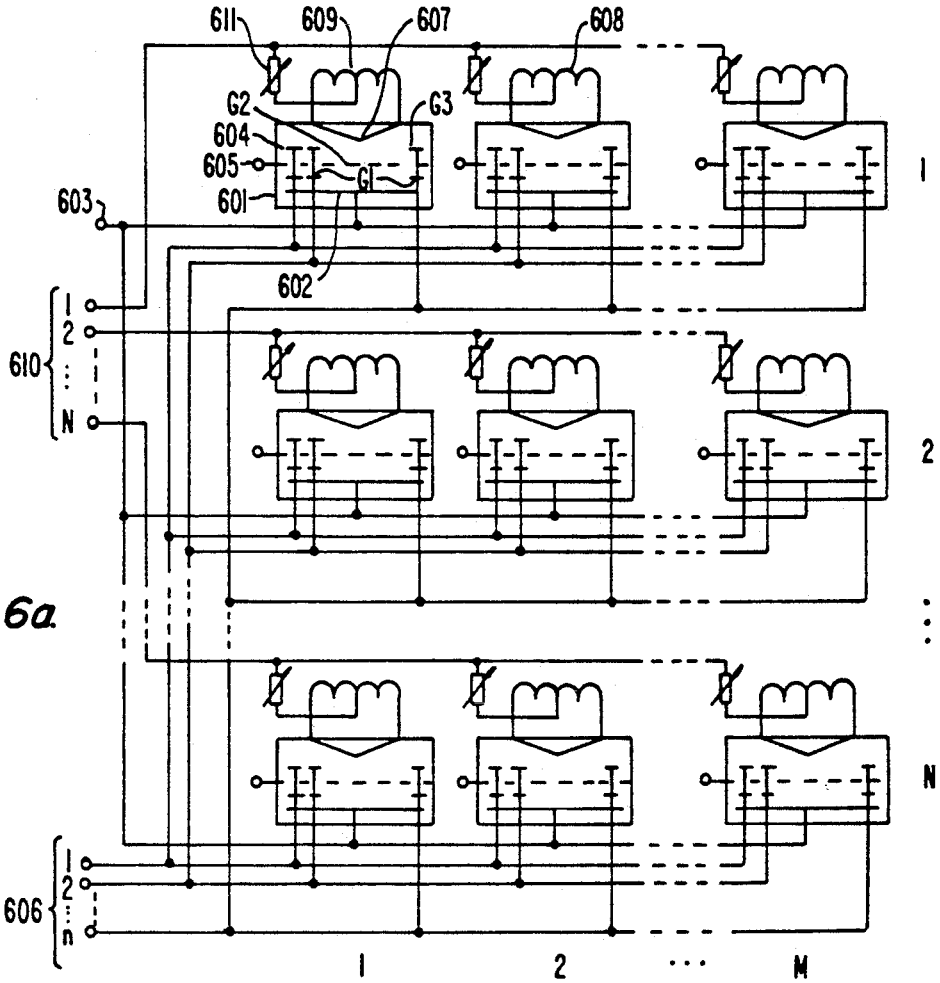
FIG. 6a is a schematic scanning circuit diagram of the control circuits for operating a mosaic visual display device having N rows and M columns of the display panels to illustrate the preferred embodiment of the invention.

FIGS. 6*a* and 7 illustrate the control circuit for controlling the display of information of a mosaic device constructed using panels of the type such as device 101 shown in FIG. 1*a*. As shown in FIG. 6*a*, the mosaic display includes N rows and M columns of panels 601. For simplicity, the mosaic display may include only two rows and three columns of panels as shown in FIG. 7. Focusing first on the panel 601 that is labeled in FIG. 6*a*, panel 601 includes anode 602, scanning electrodes G1, G3 (604) and data or brightness electrodes G2. As discussed above, each corresponding pair of corresponding electrodes in sets G1, G3 are connected. A cathode filament 607 is heated by means of the secondary coil of a DC/AC converter 609. The primary coil is not shown in FIG. 6*a* but is located in block 118 of FIG. 1. The secondary coil 609 supplies an AC voltage to filament 607, heating up the element as long as the mosaic display is on.

All the anodes 602 of the panels in FIG. 6*a* are connected to node 603 and a constant voltage is applied to the node. The display functions of the mosaic display is achieved by applying different voltages to the filaments and the grid electrodes. As shown in FIG. 6*a*, the DC voltage of all the elements in the first N rows of panels are all connected to a common node "1" in the connector 610. This connection is made between node "1" through a variable resistor 611 to the center point of secondary coil 609 so that the DC level applied through the node is not affected by the AC voltage in coil 609. The function of resistor 611 is to permit the user to adjust the DC voltage of the particular cathode in a panel so as to achieve uniformity in brightness as between panels.

Thus when a certain voltage is applied to node 1 in connector 610, all of the filaments 607 in the first row of panels will be at a set voltage. Similarly, all the cathodes in the second row of panels are connected in a similar manner to a common node 2 in connector 610. This pattern then repeats throughout the N rows of panels. Each panel 601 in the N×M array in FIG. 6*a* has n rows and m columns of pixel dots as shown in FIG. 7. In the particular case in FIG. 7, each panel has twenty-four rows and thirty-six columns of pixel dots. As again shown in FIG. 6*a*, the pair of corresponding grid electrodes in G1, G3 addressing the very first line of pixel dots in the first row of panels (N=1) are connected to a common node 1 in connector 606. This pattern again repeats for all the n pairs of scanning electrodes in the panel, thereby connecting the pairs to the corresponding n nodes in connector 606.

Figure 6B:
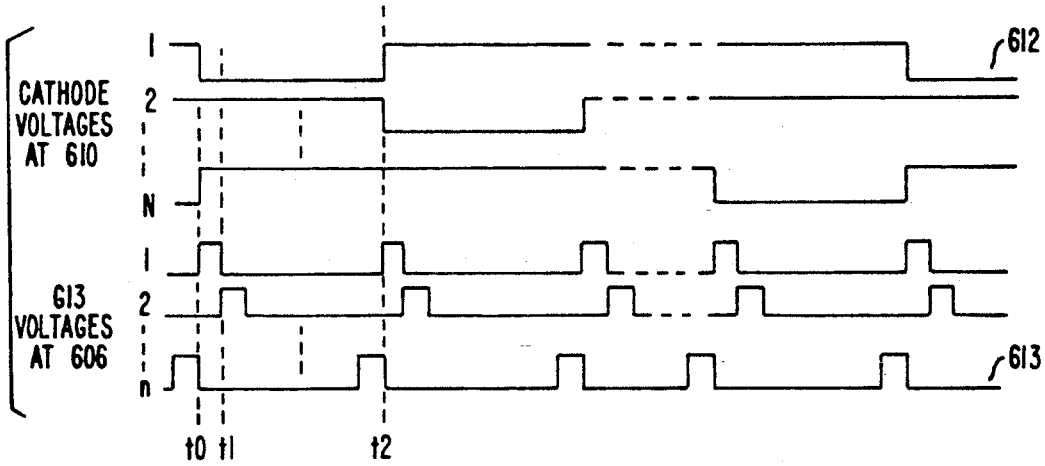

The operation of the device will now be described in reference to the timing diagram in FIG. 6*b*. As shown in FIG. 6*b*, at time $t_0$, the voltage applied to node 1 at connector 610 falls low and the voltage applied to node 1 at connector 606 rises. This causes electrons emitted by the filament in the first row of panels to travel across the first line of pixel dots (n=1) in a first row of panels (N=1) in reference to FIG. 7. The brightness of the images displayed at the first line of pixel dots will be determined by the voltages at electrodes G2 as described below. At a later time t1, the voltage at node 1 in connector 610 remains low but the voltage applied to node 1 at connector 606 falls low; when this happens, there is either no potential difference or insufficient potential difference between the cathodes and the scanning electrodes for the first line of pixel dots so that the phosphor elements in such line no longer emits light.

At time t1, an on voltage is applied to node 2 in connector 606, causing the phosphor in the second line of pixel dots (n=2, N=1) to emit light. During times t0 and t1 the remaining pixel lines (n=3-24, N=1) as well as the remaining panels (N=2) will not emit light. This pattern is repeated so that each of the twenty-four rows or lines of pixel dots in the first row of panels (N=1) has finished emitting light. At time t2, the voltage applied to node 1 in connector 610 rises to an on voltage so that the electrons emitted by the filaments in the first row of panels (N=1) will no longer be able to reach the anode, so that the entire row of such panels will remain dark. However, at time t2, the voltage applied to node 2 of connector 610 falls low and the circuit in FIG. 6*a* then permits all twenty-four rows or lines of pixel dots in the second row of panels (N=2) to be scanned. This process then is repeated for all rows of panels (when N is greater than 2) until all the pixel dot lines and all the rows of panels have been scanned. Then the entire process is repeated from the first pixel line and the first row of panels.

It is noted that in the above-described process, one pixel dot line is scanned and emits light at the same time. This is different from conventional devices where it is necessary to scan more than one line at a time. The difference is due to the fact that the luminscence of the panels is greater than conventional devices so that full screen scanning is possible and it is unnecessary to scan more than one line at the same time. This greatly reduces the complexity of the circuitry and therefore the thickness of the display device.

Figure 8:
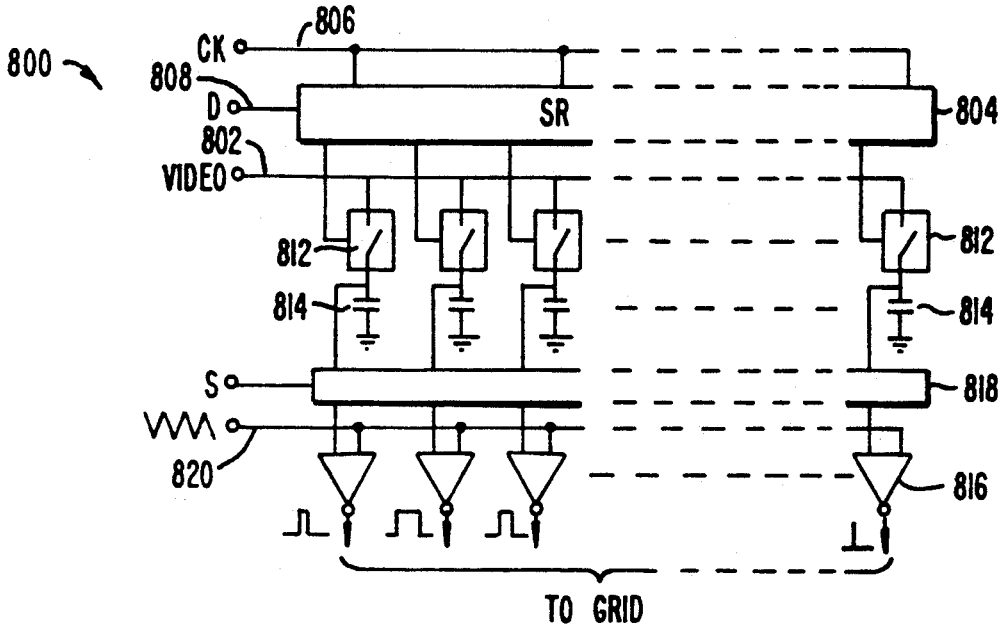
FIG. 8 is a schematic circuit diagram which operates in conjunction with the circuit of FIG. 6a for operating the mosaic visual display device.

The brightness control circuit will now be described with reference to FIG. 8. Circuit 800 includes the video line 802 which supplies video data to be sampled and displayed. Such data is sampled by a shift register 804 driven by a clock line 806 and a line pulse D 808. The shift register 804 closes switches 812 sequentially, causing the sampled video signal to be stored in capacitors 814. Thus the capacitors 814 would store a large number of samples of the video signal as sampled in a time sequence. The sampled values are each applied to the input of a corresponding comparator 816 through a switch 818 where the comparator compares the stored samples to a saw tooth signal to line 820. In this manner, the amplitude of the samples stored in capacitors 814 are converted by the comparators into square pulses whose widths are proportional to the amplitude of the stored samples. The outputs of the comparators 816 are then applied directly to the data electrodes in set G2 of the different panels in FIG. 6*a* in a manner described below.

As described above, the entire pixel dot line of all the panels in a particular row of panels is scanned or addressed at the same time. Thus at time tO in FIG. 6*b*, upon the rising edge of the rising voltage pulse applied to node 1 in connector 606, all the brightness data present on the electrodes in set G2 in the entire first row (N=1) of the panels will be effective in affecting the brightness of the phosphor emitted by the first pixel dot line (n=1, N=1). Thus at time t0, all of the outputs of comparators 816 present on the grid lines in sets G2 will affect the brightness of such lines scanned. Thus at time t0, switch 818 would permit the stored samples from capacitors 814 to be supplied to comparators 816 so that the corresponding pulse width modulated square pulses will be applied to the electrodes in sets G2. Thus the number of comparators 816 should equal at least the number of grid electrodes in the sets G2 in one row of panels. For the configuration in FIGS. 6*a*, there must be at least m.M comparators. In the context of FIG. 7, there must be at least 363 comparators or 108 comparators. Similarly, there must be m.M capacitors 814, switches 812 and there must be at least m.M bits in shift register 804. Two circuits 800 are employed so that when one is supplying data, the other is sampling the video data to prepare for the next line scan.

Figure 9:
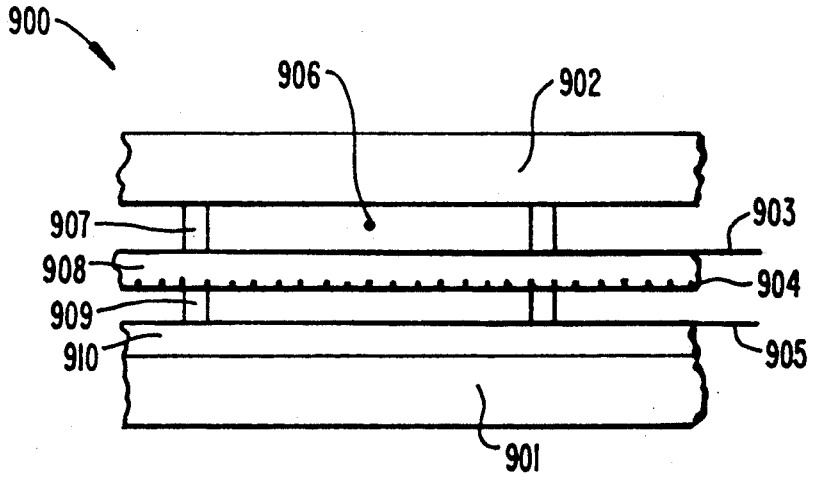
FIG. 9 is a cross-sectional view of a portion of the device in FIG. 1a to illustrate the preferred embodiment of the invention.

As indicated above in the case of conventional displays, the spacers used extend all the way between the face plate and the back plate of the panel. This is undesirable since it creates a bigger obstacle to electrons reaching the phosphor material on the anode. In FIG. 9, three levels of spacers are used between the face plate 901 and back plate 902. Planes 903, 904 and 905 are where the three sets of grid electrodes G1, G2, and G3 are located. Only one cathode 906 filament is shown as substantially parallel to the grid electrodes G2 in plane 904. Spacers 907, 908, 909 and 910 are each in the form of elongated strips where the lengths of spacers 907 and 909 are substantially perpendicular to the plane of FIG. 9 and the lengths of spacers 908 and 910 are substantially parallel to the plane of FIG. 9. In other words, alternate layers of spacers formed a staggered crisscrossing structure. This substantially reduces the obstruction posed by the spacers to the paths of the electrons between the cathode and the anode and therefore reduces the dark areas of the display compared to conventional designs. Furthermore, these spacers serve to support and fix spatially the positions of the grid electrodes and reduces sagging or vibrations of the grid electrodes. As more elongated strip type spacers are used, it will be evident that other geometrical shapes of spacers may also be used such as circular or curved as long as they are again separated into sections, each section fitting between the planes of electrodes will perform a similar function and are within the scope of the invention.

While the invention has been described by reference to various embodiments, it will be understood that various modifications may be made without departing from the scope of the invention which is to be limited only by the appended claims.

What is claimed is:

1. A cathodoluminescent visual display device having a plurality of pixel dots, comprising:

an anode;

luminescent means that emits light in response to electrons, and that is on or adjacent to the anode;

a cathode;

three sets of elongated grid electrodes between the anode and cathode, the electrodes in each set overlapping those in at least one other set at points, wherein the overlapping points define the pixel dots, said anode and cathode being in two planes that are spaced apart, wherein said first, second and third sets of grid electrodes are in a first, second and third planes that are different from one another, said first, second and third planes being located between the planes of the anode and cathode, said second plane being between the first and third planes; and means for heating the cathode, causing the cathode to emit electrons;

means for applying electrical potentials to the anode, cathode and the three sets of grid electrodes, causing the electrons emitted by the cathode to travel to the anode at the pixel dots for displaying images, wherein the electrical potential applying means applies a voltage substantially in range of 500 to 3000 volts to the anode, and wherein the electrica potential applying means applies electrical potentials suitable for scanning to the first and third sets of grid electrodes and electrical potentials suitable for carrying brightness information to the second set of grid electrodes.

2. The device of claim 1, wherein said grid electrodes include electrically conductive wires, thereby increasing the osmotic coefficient of the grip electrodes.

3. The device of claim 1, further comprising:

housing means for housing the anode, cathode and sets of grid electrodes; and means connected to the housing means for supporting the grid electrodes and for reducing vibrations of the electrodes.

4. The device of claim 1, wherein each of at least some grid electrodes in the first set is parallel to and correspond to a grid electrode in the third set defining a pair of corresponding electrodes, wherein each pair of corresponding grid electrodes in the first and third sets overlaps the grid electrodes in the second set at the same pixel dots;

said device further comprising electrically conductive means connecting each pair of the corresponding grid electrodes, so that said electrical potential applying means applies substantially the same potentials to each corresponding pair of grid electrodes, thereby increasing the luminescence of the device.

5. The device of claim 1, wherein said electrical potential applying means applies substantially the same potentials to a grid electrode in the first set and a grid electrode in the third set to increase the luminescence of the device, said two grid electrodes overlapping at the same pixel dots.

6. The device of claim 1, said anode comprising a continuous electrically conductive body, and three primary color low voltage cathodoluminescent phosphor material on said body.

7. The device of claim 1, said pixel dots of the device being arranged along arrays of lines, said electrical potential applying means applying such potentials to the anode, cathode and grid electrodes that the electrons emitted by the cathode travels to the anode at only one line of pixel dots at a time to achieve full screen scanning.

8. The device of claim 1, wherein said electrical potentials applying means applies voltages in a range of about 0–60 volts to the cathode and to the second set of grid electrodes, and in a range of about 0–12 volts to the first and third sets of grid electrodes.

9. A mosaic cathodoluminescent visual display device having a plurality of display panels arranged in an array to form a mosaic display, each panel having pixel dots, and each panel comprising:

an anode;

luminescent means that emits light in response to electrons, and that is on or adjacent to the anode;

a cathode;

two or more sets of elongated grid electrodes between the anode and cathode, the electrodes in each set overlapping those in at least one other set at points, wherein the overlapping points define the pixel dots;

means for heating the cathode, causing the cathode to emit electrons;

means for applying electrical potentials to the anode, cathode and the two or more sets of grid electrodes, causing the electrons emitted by the cathode to travel to the anode at the pixel dots for displaying images; and a housing holding said anode, cathode and grid electrodes, wherein said cathode includes one or more filaments each comprising a center core material and a coating, and two springs connecting each filament to the housing, said springs being made of substantially the same material as the filament center core material, thereby reducing cold terminal effects, and width of any dark line or lines between the panels.

10. The device of claim 9, wherein at least one set of grid electrodes is for scanning the pixels, wherein at least one of said scanning electrodes overlaps a spring, and wherein said electrical potential applying means applies such potentials that the potential difference between the cathode and said at least one electrode is greater than that between the cathode and a scanning electrode that does not overlap the spring.

11. The device of claim 9, wherein at least one set of grid electrodes is for scanning the pixels, and at least some of said scanning electrodes overlaps a spring at one or more pixel dots, and wherein the at least some overlapping scanning electrodes are spaced apart at closer spacings than the scanning electrodes that do not overlap any spring.

12. A mosaic visual display device comprising N rows and M columns of display panels, N, M being positive integers, each panel including:

an anode;

luminescent means that emits light in response to electrons, and that is on or adjacent to the anode;

a cathode;

two or more sets of elongated grid electrodes between the anode and cathode, including one set of n scanning electrodes and a set of m data electrodes, n, m being positive integers, said n scanning electrodes and m data electrodes overlapping one another at points and defining a matrix of n.m pixel dots at the overlapping points, said matrix having n rows;

said device further comprising:

n first drivers each connected to one of the n scanning electrodes for scanning the n rows of the matrix;

N second drivers each connected to the cathodes of one of the N rows of panels, said first and second drivers in combination scanning all the n.N rows of pixel dots in the device.

13. The device of claim 12, further comprising means for sampling a video signal and supplying the sampled signal to the data electrodes.

14. The device of claim 13, said sampling and supplying means including one or more electrically conducting wires.

15. The device of claim 12, further comprising adjustable means connected between each panel and the second drivers for modifying the electrical potentials of the cathodes in order to adjust the relative brightness of the panels.

16. The device of claim 15, wherein said adjustable means includes N.M variable resistors.

17. A cathodoluminescent visual display device having a plurality of pixel dots, comprising:

an anode;

luminescent means that emits light in response to electrons, and that is on or adjacent to the anode;

a cathode, said anode cathode being in two planes that are spaced apart;

a first, second and third set of elongated grid electrodes in respective first, second and third planes between the planes of the anode and cathode, said second plane being between the first and third planes, the electrodes in each set overlapping those in at least one other set at points, wherein the overlapping points define the pixel dots;

means for heating the cathode, causing the cathode to emit electrons; and means for applying electrical potentials to the anode, cathode and the first, second and third sets of grid electrodes, causing the electrons emitted by the cathode to travel to the anode at the pixel dots for displaying images;

wherein each of at least some grid electrodes in the first set is parallel to and correspond to a grid electrode in the third set defining a pair of corresponding electrodes, wherein each pair of corresponding grid electrodes in the first and third sets overlaps the grid electrodes in the second set at the same pixel dots;

said device further comprising electrically conductive means connecting each pair of the corresponding grid electrodes, so that said electrical potential applying means applies substantially the same potentials to each corresponding pair of grid electrodes, thereby increasing the luminescence of the device.

18. The device of claim 17, said device further comprising a first spacer means between the cathode and the first set of grid electrodes, a second spacer means between the first and second sets of grid electrodes, a third spacer means between the second and third sets of grid electrodes and a fourth spacer means between the anode and the third set of grid electrodes.

19. The device of claim 18, wherein said first, second, third and fourth spacer means are elongated members in contact with at least one set of grid electrodes.

20. The device of claim 19, wherein the length of the member of at least one of the second or third spacer means is transverse to the lengths of the members of the first and fourth spacer means.

21. The device of claim 12, wherein the first and second drivers are such that not more than one row of pixel dots is scanned at any time.

22. The device of claim 9, wherein the two springs are bent filaments.

* * * * *

UNITED STATES PATENT AND TRADEMARK OFFICE

CERTIFICATE OF CORRECTION

PATENT NO. : 5,170,100

DATED : December 8, 1992

INVENTOR(S) : Shichao et al.

It is certified that error appears in the above-identified patent and that said Letters Patent is hereby corrected as shown below:

| | |
|---|---|
| Column 13, line 11, in Claim 1 | Replace "electrica" with --electrical-- |
| Column 13, line 19, in Claim 2 | Replace "grip" with --grid-- |
| Column 15, line 10, in Claim 17 | Insert --and-- after "anode" |

Signed and Sealed this

Twenty-second Day of November, 1994

*Attest:*

*Attesting Officer*

Bruce Lehman

BRUCE LEHMAN

*Commissioner of Patents and Trademarks*